United States Patent [19]

Conrad

[11] Patent Number: 4,507,876

[45] Date of Patent: Apr. 2, 1985

[54] END SEAL FOR ROTARY TREATING DRUM

[75] Inventor: Lucas J. Conrad, Winston-Salem, N.C.

[73] Assignee: R. J. Reynolds Tobacco Company, Winston-Salem, N.C.

[21] Appl. No.: 497,009

[22] Filed: May 23, 1983

[51] Int. Cl.[3] ..... F26B 25/08

[52] U.S. Cl. ..... 34/242; 34/135; 34/141; 432/242

[58] Field of Search ..... 34/242, 135, 136, 137, 34/140, 141, 142; 432/242, 115

[56] References Cited

U.S. PATENT DOCUMENTS

| | | | |
|---|---|---|---|
| 3,724,887 | 4/1973 | Roberts | 34/242 |
| 3,940,239 | 2/1976 | Rossi et al. | 34/242 |
| 4,193,756 | 3/1980 | Leon | 34/242 |

*Primary Examiner*—Larry I. Schwartz

*Attorney, Agent, or Firm*—Manford R. Haxton

[57] ABSTRACT

Apparatus for preventing the escape of volatile treating agents into ambient air from a rotary treating drum used in treatment of particulate solids such as tobacco is disclosed. The apparatus comprises a flange on each end of the drum against which a washer is urged while a gas, such as air, is introduced between each flange and its associated washer ring.

2 Claims, 7 Drawing Figures

FIG. 2.
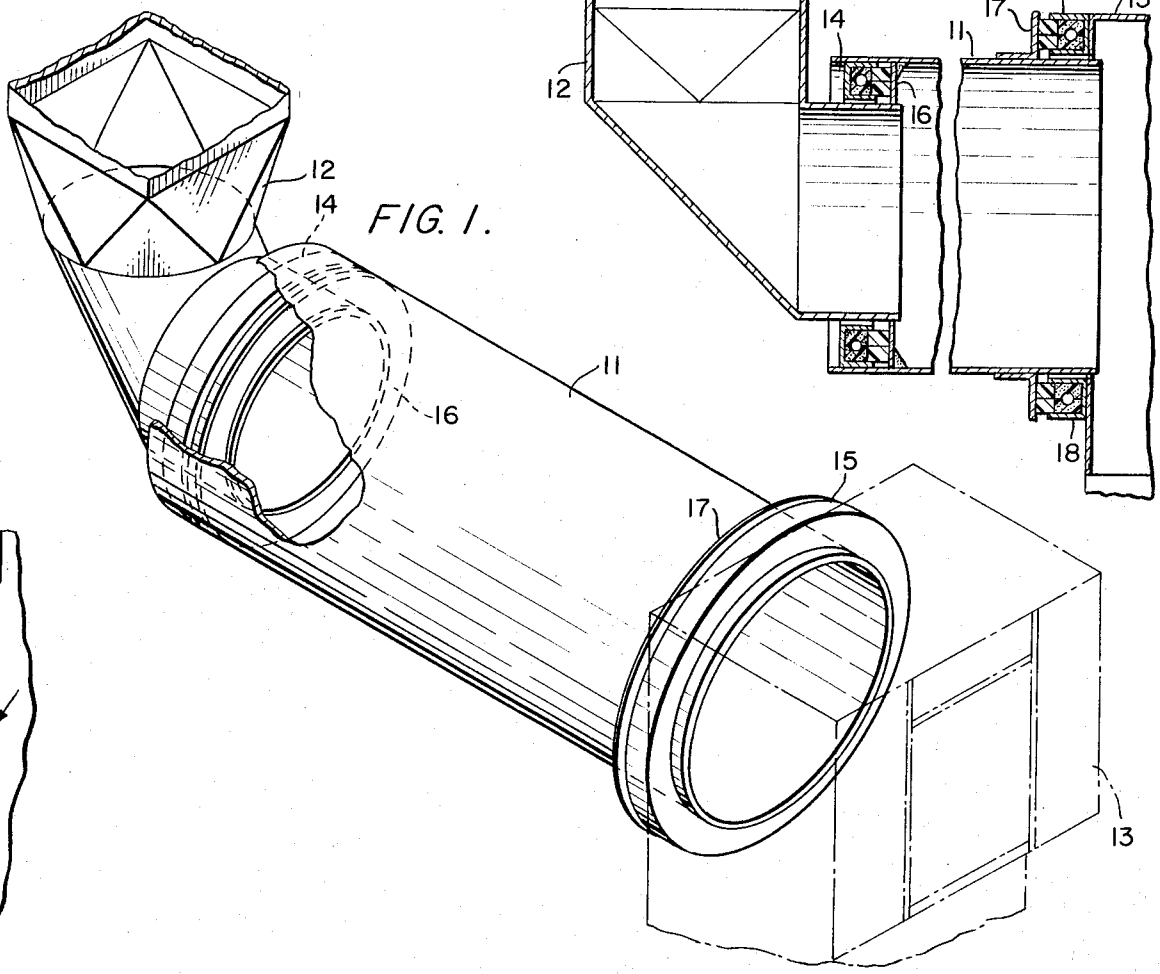
FIG. 1.
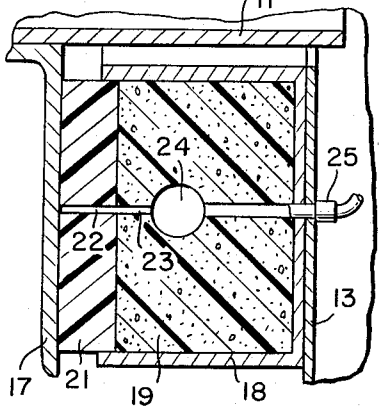
FIG. 3
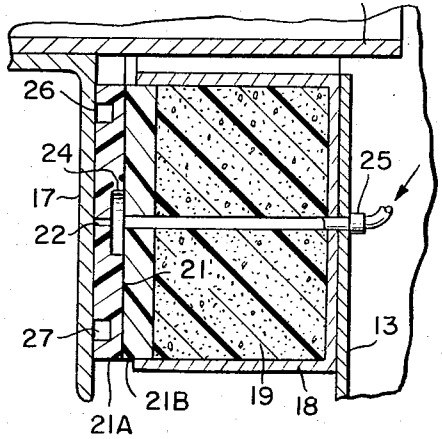
FIG. 4.

END SEAL FOR ROTARY TREATING DRUM

BACKGROUND OF THE INVENTION

Open cylindrical rotary drums have been used for many years for the purpose of adding moisture to, or for the drying of, a stream of particulate solid material. Such drums are mounted on rollers with the longitudinal axis inclined from the horizontal so that material passed into the elevated end of the drum will move toward and exit from the lower end. The interior of the drum is usually provided with longitudinal flights attached to the inner surface so that solid materials are lifted as the drum rotates and dropped through the atmosphere within the drum to effect stirring and increased exposure of solid material to the drum atmosphere. For example, in the tobacco industry such drums as used extensively for adding water to tobacco to increase its pliability and reduce breakage during subsequent handling. This is accomplished by mounting water spray nozzles within the drum to spray a mist of water onto the tobacco as it moves through. For this application, there is no need to seal the ends of the drum.

Rotary treating drums are also used for treating tobacco with low quality steam in order to increase the moisture content and temperature of the tobacco. For this application, the ends of the drum are enclosed in a housing in order to prevent the escape of an excessive amount of steam, however, a tight seal is not necessary because escape of a small amount of steam is not detrimental.

SUMMARY OF THE INVENTION

The present invention provides apparatus for preventing the escape of volatile treating agents into ambient air from a rotary treating drum being used in the treatment of particulate solids such as tobacco. In the treatment of cigarette cut filler with volatile flavorants such as menthol, it is desirable to prevent the escape of such flavorants into the ambient air. To accomplish this, each end of the rotary treating drum is enclosed in a housing provided with suitable airlock means to transfer tobacco into the inlet end and away from the outlet end of the drum. The present invention provides end seal means for preventing leakage of gaseous treating agent from the area between the housings and the ends of the rotary treating drum. The end seal of the present invention comprises a flange attached at an end of the rotary treating drum in a plane perpendicular to and concentric with the axis of rotation of the drum, the flange being provided with a central opening through which materials may be introduced to or withdrawn from the interior of the drum, a washer mounted on the housing adjacent the flange concentric with the axis of the drum, means adapted for introducing gas between the washer and the flange and urging means adapted to urge the washer toward the flange.

The mounting for the end seal washer comprises a circular member of U-shaped cross-section with its open side facing the flange. The washer, preferably made of a thermoplastic material such as high-density polyethylene, is adapted to move freely within the U-shaped member but is not permitted to rotate. A resilient material, such as polyurethane foam, is located within the U-shaped member behind the non-rotating washer to urge the face of the washer against the rotating flange mounted on the rotary treating drum. A series of holes is drilled through the washer to provide orifices in the face of the washer abutting the flange. These orifices are connected by a manifold located within the U-shaped member to a source of gas under pressure such as compressed air. The gas is forced through the orifices into the junction between the washer and the flange to reduce friction and wear and keep the seal area free of treating agent. If desired, a scavenging groove may be cut into the face of the washer between the row of orifices and the inside of the drum and the groove connected to conduit means for removing gas from between the washer and the flange, thus minimizing the amount of sealing gas which enters the drum. In applications where it is desired that the sealing gas not enter the ambient air, a second scavenging groove is cut into the face of the washer between the row of orifices and the outer periphery of the washer and this scavenging groove is connected by conduit means to a gas disposal system.

Thus, there is provided an end seal for a rotary treating drum which effectively prevents escape of treating agents from the drum into the ambient air while reducing the friction between the sealing elements to prevent excessive wear.

BRIEF DESCRIPTION OF THE DRAWINGS

The drawings illustrate the best mode presently contemplated for carrying out the invention.

In the drawings:

FIG. 1 is a cutaway perspective view of a rotary treating drum with inlet and outlet housings.

FIG. 2 is a partial side view of a rotary treating drum with inlet and outlet housings supporting the non-rotating members of the seals of the invention.

FIG. 3 is a cross-sectional view of an embodiment of the seal of the invention.

FIG. 4 is a cross-sectional view of another embodiment of the seal of the invention.

DESCRIPTION OF THE PREFERRED EMBODIMENTS

Figure 5:
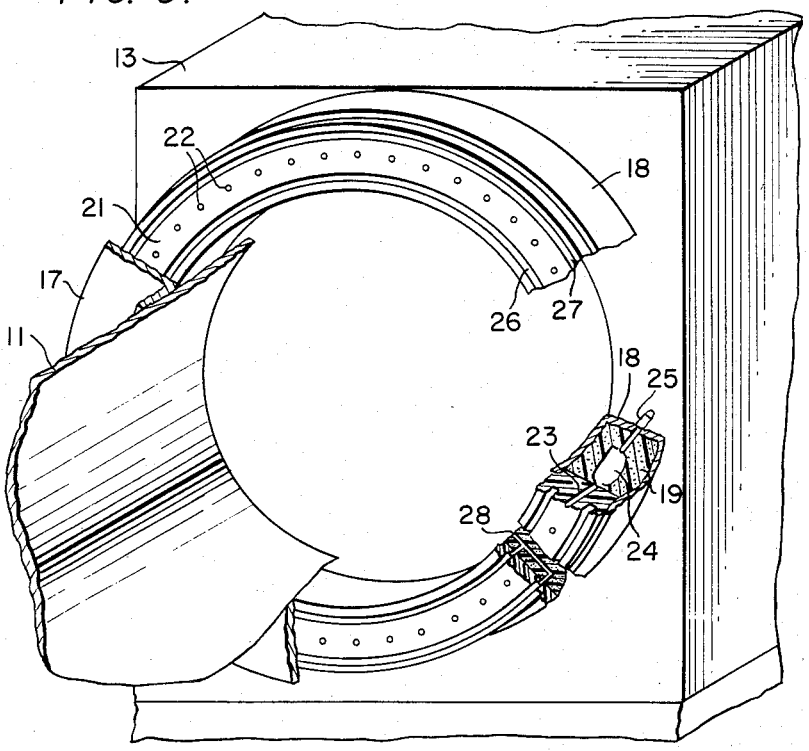
FIG. 5 is a cutaway perspective view of the discharge end of a rotary treating drum and the outlet housing equipped with the seal of the invention.

An enclosed particulate solids treating system as shown in FIG. 1 comprises a rotary treating drum 11, inlet housing 12 for admitting solids into the drum, and an outlet housing 13 for receiving solids leaving the exit end of the drum 11. The end seal 14 at the inlet end of the drum is mounted on the inlet housing 12 and the end seal 15 at the outlet end of the rotary treating drum is mounted on the outlet housing 13.

As can be see in FIG. 2, the end seal at the inlet end of the rotary drum is smaller in diameter than the drum itself while the end seal 15 at the outlet end of the rotary drum is larger in diameter than the drum. The flange element 16 of the end seal 14 at the inlet end of the drum is attached in a gas-tight manner, such as by welding, to the shell of the drum 11 in a position concentric with the axis of the drum and in a plane perpendicular to the drum axis. The inlet housing 12 extends into the drum so that solids being introduced to it will readily pass into the drum, while outlet housing 13 is larger than the drum 11 and encloses the outlet end of it so that solids passing from the drum readily drop into the outlet housing 13. Thus, the flange element 17 for the drum end seal 15 at the outlet end of the drum is attached in a gas-tight manner to the exterior surface of the drum at or near the outlet end.

Illustrated in cross-section in FIG. 3 is an embodiment of the end seal of the present invention for sealing the outlet end of a treating drum. Flange 17 is attached to the outer wall of the treating drum 11. Mounting ring 18 is attached to the outlet housing 13. The mounting ring is U-shaped in cross-section and contains a ring of resilient sponge material 19, such as polyurethane foam. A washer 21, preferably of thermoplastic material such as high density polyethylene, is slidably mounted within the open side of the U-shaped mounting ring 18. The U-shaped mounting ring 18, which is fastened to the outlet housing 13, is fixed into position so that the washer 21 is urged against the flange 17 by the resilient material 19. Washer 21 is provided with orifices 22 through which gas is fed from conduits 23, manifold 24 contained within resilient material 19, and gas supply conduit 25.

Shown in FIG. 4 is another embodiment of the end seal of the present invention wherein a different construction of washer 21 is employed. In this embodiment the washer 21 is a laminated structure made up of ring 21A of thermoplastic material and ring 21B of the same or other suitable material. Prior to laminating the two rings 21A and 21B together, manifold 24 is formed by cutting a groove into ring washer 21A on the face opposite the one in contact with flange 17. Gas supply conduit 25 is connected in flow communication with groove conduit 24 which is, in turn, in flow communication with each of the orifices 22.

Illustrated in FIG. 5 is the end seal of the present invention mounted on outlet housing 13 at the discharge end of a rotary treating drum 11. Flange 17 is attached to the outside wall of treating drum 11 as previously described. Mounting ring 18 is attached to the side of outlet housing 13 which faces the treating drum. Resilient material 19 is contained within the U-shaped mounting ring in position to urge washer 21 toward the flange 17. Washer 21 is provided with orifices 22 which are in flow communication with conduit 23 via manifold 24 to gas supply conduit 25. Washer 21 is provided with scavenger grooves 26 and 27 cut into the face of the washer which abuts flange 17. In this illustration, scavenger grooves 26 and 27 are both vented to the inside of the drum by way of conduit 28 which is drilled into the washer 21 in flow communication with the scavenger grooves 26 and 27.

Figure 6:
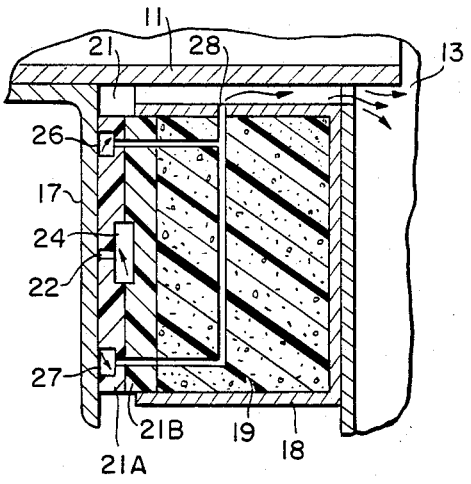
FIG. 6 is a cross-section of an embodiment of the invention having scavenging grooves vented inside the housing at the outlet end of the drum.

An embodiment of the end seal wherein the scavenging grooves 26 and 27 are both vented to the interior of the treating drum is illustrated in FIG. 6. In this embodiment, flow conduits are drilled through washer 21 from the backside into the scavenging grooves 26 and 27. These drilled flow conduits are then connected by suitable fittings and tubing to venting conduit 28. These fittings and tubing are within the enclosed area of U-shaped support member 18 which contains the resilient urging material 19. The resilient material is easily fitted around the conduits 28 so that there is minimal affect on the urging force applied by the resilient material to the washer 21. In this embodiment, scavenger groove 26 and its associated conduit may be omitted, permitting sealing gas to flow to the inside of the drum from between the flange and the washer. This embodiment is used in applications where it is desired that the sealing gas and any gases leaking from the atmosphere within the drum not be permitted to enter the ambient air around the treating drum system.

Figure 7:
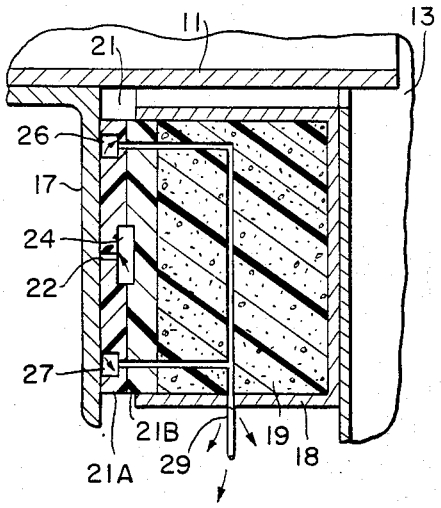
FIG. 7 is a cross-section of an embodiment of the invention wherein scavenging grooves are vented outside the drum housing.

Shown in FIG. 7 is an embodiment of the end seal wherein the scavenging grooves are vented to the outside of the drum. If desired, these gases may be collected as they pass from conduit 29 and fed to a suitable waste disposal or recovery system by conventional piping.

It is apparent that many variations and changes in the details of construction and arrangement of parts will readily suggest themselves to persons skilled in the art and still fall within the spirit and scope of this invention. Therefore, the present disclosure is meant to be merely illustrative, and the invention is to be limited only by the scope of the appended claims.

I claim:

1. An end seal for a cylindrical rotary treating drum comprising a flange attached to said drum at an end thereof in a plane perpendicular to the axis of rotation of said drum; a washer mounted on a housing adjacent said flange concentric with said axis; means for introducing gas between said washer and said flange; and urging means adapted to urge said washer toward said flange, said urging means comprising resilient sponge material enclosed on three sides within a mounting ring of U-shaped cross-section with the fourth side of said material in urging relationship to said washer.

2. An end seal for a cylindrical rotary treating drum comprising a flange attached to said drum at an end thereof in a plane perpendicular to the axis of rotation of said drum; a washer mounted on a housing adjacent said flange concentric with said axis, said washer being provided with a plurality of orifices arranged along the circular face of said washer adjacent said flange; conduit means adapted to provide gas to each of said orifices; and urging means adapted to urge said washer toward said flange.

* * * * *